United States Patent [19]

Pierrat

[11] Patent Number: 4,907,950

[45] Date of Patent: Mar. 13, 1990

[54] VARIABLE POSITIVE FLUID DISPLACEMENT SYSTEM

[76] Inventor: Michel A. Pierrat, 277 Forrest La., Boulder, Colo. 80301

[21] Appl. No.: 238,093

[22] Filed: Aug. 29, 1988

[51] Int. Cl.[4] ..... F04B 1/00

[52] U.S. Cl. ..... 417/271; 417/273; 417/429; 417/518; 91/481; 91/492; 91/497

[58] Field of Search ..... 417/62, 269, 271, 273, 417/514, 515, 518, 523, 415, 429; 91/477, 480, 481, 492, 493, 497, 498

[56] References Cited

U.S. PATENT DOCUMENTS

| | | | |
|---|---|---|---|
| 603,805 | 5/1898 | Wood | 417/515 X |
| 2,095,255 | 10/1937 | Holmes | 91/498 |
| 2,366,186 | 1/1945 | Freeman | 417/514 |
| 2,544,055 | 3/1951 | Staats | 91/481 X |
| 2,712,301 | 7/1955 | Gravely et al. | 91/498 |
| 2,725,182 | 11/1955 | Spriggs | 417/523 X |
| 3,075,504 | 1/1963 | Vogel | 91/491 X |
| 3,583,286 | 6/1971 | Chiappulini et al. | 91/491 |
| 4,066,002 | 1/1978 | Eastman | 91/492 X |
| 4,316,705 | 2/1982 | Siewart | 417/273 |
| 4,729,720 | 3/1988 | Fujita | 417/271 |

FOREIGN PATENT DOCUMENTS 0536936 12/1955 Italy ..... 417/515

*Primary Examiner*—Leonard E. Smith
*Assistant Examiner*—Eugene L. Szczecina, Jr.
*Attorney, Agent, or Firm*—E. T. Barrett

[57] ABSTRACT

A fluid pump has two pairs of rectangular oppositely-disposed pistons. The pistons of each pair travel simultaneously in opposite directions at the same speed and over the same distance. Valving is provided by a reciprocating port plate, in face-to-face relation to the piston, driven in a circular path from two spaced crankpins and which in turn drives the associated piston. The sliding movement of the port plate controls the alignment of inlet and exhaust ports in the piston and port plate. The excursion or "throw" of the pistons can be varied from zero to maximum. A crankpin throw-adjusting mechanism simultaneously adjusts the throw of each crankpin, some in one direction, some in the opposite, so that all chambers are automatically adjusted for varying, but always identical, displacements. Self-lubricated seals between the piston and chamber walls are spring loaded, by an elastomerically sealed structure having non-linear deflection-to-force characteristics.

18 Claims, 12 Drawing Sheets

VARIABLE POSITIVE FLUID DISPLACEMENT SYSTEMBACKGROUND OF THE INVENTION

1. Field of the Invention

This invention relates to reversible fluid displacement pumps useful as superchargers for internal combustion engines, compressors and expanders, automotive air-cycle air conditioning and other types of refrigeration, etc. More particularly, the invention relates to such an apparatus that is self-lubricated and in which a high volume of fluid is displaced at a variable rate.

2. Description of the Related Art:

Variable positive displacement systems have been in wide use for high pressure, relative small displacement applications Such units require closely fitting parts that are lubricated by the lubrication properties of the fluid or by a lubricant mist carried in the fluid being displaced. Superchargers of various types have been used in connection with gasoline and diesel engines.

U.S. Pat. Nos. 4,112,826 and 4,270,495 disclose engines having alterable piston stroke lengths to change the compression ratios of the engine. The engine has a pair of parallel cylinders in side by-side relationship. An adjustable crankshaft mechanism produces changes in piston stroke length and compression ratios.

U.S. Pat. Nos. 1,873,908 and 3,861,239 disclose an engine having a connecting rod coupled to the crankshaft by an eccentric bearing that rotates during engine operation to alter the piston stroke.

U.S Pat. No. 4,485,768 describes an engine with a yoke-crankshaft structure having opposing pistons fitted to each end. The yoke is driven by an eccentric crankpin arrangement which imparts an orbital motion to a slider within a raceway in the yoke. A gear-actuated mechanism varies the length of the piston stroke. Other patents showing arrangements for varying the length of the stroke of the crankshaft in an engine include: U.S. Pat. Nos. 4,174,684; 4,345,550; 3,731,661; 4,422,414; and 4,535,596.

Various individual elements of the present invention are suggested in some earlier constructions, but none combine these elements into a structure that meets the absolute requirements for, say, a practical supercharger. These absolute minimum requirements relate to operating life; cost; size; weight; and efficiency. In addition, for maximum practical application, the displacement must be readily and instantaneously variable in accordance with control parameters derived from operating conditions.

SUMMARY OF THE INVENTION

The present invention provides an improved variable positive fluid displacement apparatus, operating either as a pump or as a motor, that is self lubricated, has high volumetric capacity and operates with high efficiency over a wide range of speeds and pressures.

The variable positive displacement apparatus has two pairs of oppositely disposed pistons. The pistons of each pair travel simultaneously in opposite directions at the same speed and over the same distance to cancel the effects of inertia without the use of counterbalance elements.

The pistons are rectangular in shape, have relatively large areas and move at lower speeds, relative to displacement, than conventional devices of this type. Each piston is driven by two spaced crankpins on a drive shaft that stabilize the motion of the piston in one plane while the piston is stabilized in a perpendicular plane by a fluid port duct that carries the fluid being exhausted from or entering the chamber.

The valving for each cylinder is provided by a reciprocating port plate that is driven from two spaced crankpins and which in turn drives the associated piston. The effectiveness of the bi-directional valving, which is provided by a port arrangement, is subject to increased sealing pressures from the pressure in the cylinder.

The apparatus has valving operable in such manner that the device can operate as a pump with its input shaft being driven from an external source, or as a motor by subjecting it to high fluid pressures. No modification of the mechanism is required to operate either as a motor or as a compressor.

A self-lubricated sliding valve system, wear and pressure-compensated, operates at a linear velocity proportional to the cosine of the rotational angle of the crankshaft while the linear velocity of the piston is proportional to the sine of the same angle. When the piston is at minimum velocity, the valving components are moving at maximum velocity. When the piston is moving at its maximum velocity, that is when the volume of fluid is being displaced at its maximum rate, the sliding valve components are stationary and in the full open position for minimum flow restriction.

Each piston is in face-to-face relation with a sliding port plate that is driven in a circular path, by two spaced leg assemblies, while being restrained from any twisting motion relative to the piston. The component of the circular motion parallel with the path of the piston produces the reciprocation of the piston, while the component of the circular motion transverse to the axis of movement of the piston slides the port plate in a plane perpendicular to the axis of movement of the piston. This sideways movement of the port plate controls the intake and fluid exhaust ports by changing the alignment of fluid ports in the piston and in the port plate. When the piston and port plate are at the part of the circular drive near the end of the piston stroke, the transverse component of movement is dominate and the port openings change rapidly with respect to the motion of the piston. When the piston is at mid-stroke, the component of the circular motion producing the piston movement is at its maximum and the movement of the port plate in the transverse plane is minimal.

It is important to be able to vary the displacement of the apparatus independently of changes in operating speed. In the device described here, the excursion or "throw" of the pistons can be varied from zero to maximum to best suit the apparatus to the current operational requirements. A linear control rod, adjustable while the apparatus is operating, simultaneously and precisely adjusts the throw of all pistons. A crankpin throw-adjusting mechanism simultaneously adjusts the throw of each crankpin, some in one direction, some in the opposite, so that all chambers are automatically adjusted for varying, but always identical, displacements.

The entire apparatus is self lubricated and is capable of handling air or other non-lubricating fluids. The self-lubricated seals between the piston and chamber walls are spring loaded, by an elastomerically sealed structure having non-linear deflection-to-force characteristic. The seals are capable of accommodating wide gaps between the pistons and the chamber walls while preventing the pistons from touching the chamber walls even under conditions producing unusual lateral forces.

To meet the practical needs of the market place, the cost of the apparatus must be within acceptable limits. It is readily possible using known structures to provide various features of the present invention for theoretical operation. But such structures cannot meet the cost and weight limitations inexorably imposed on a practical device. The apparatus employs only simple modular components that form the displacement chambers and house the driving and throw-adjusting members. These modular, easily-machined parts form not only the internal parts of the apparatus but also the housing for the entire unit. No expensive and difficult to machine monoblock housing is required.

DESCRIPTION OF THE PREFERRED EMBODIMENT

For purposes of explanation, the operation of the unit is considered as a supercharger, in which the fluid being pumped is air, such as would be used in conjunction with an internal combustion engine, but it is to be understood the device can also be operated as a motor by the application of fluid pressure. In the latter event, the functions of certain components will be reversed from the manner in which they are described here. For example, a port that functions as an exhaust port in the first instance may be regarded as an input port in the second instance.

In the description, letter suffixes have been used in connection with a generic numeral designation to indicate similar parts. Because many parts are equivalent in structure, the parts may be designated only by the generic number where the suffix is not deemed to be essential to the description.

Figure 1:
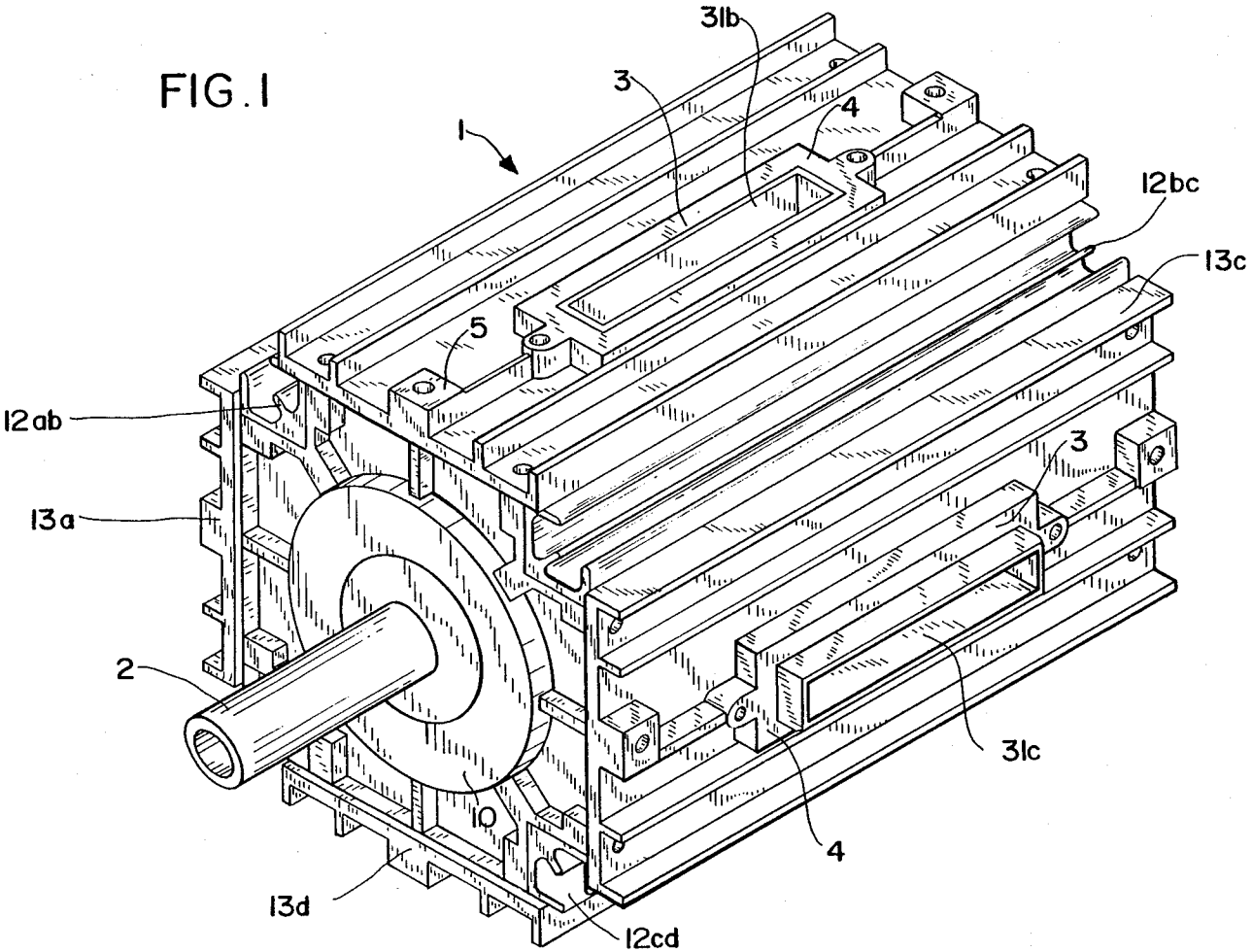
FIG. 1 is a perspective view of an apparatus embodying the invention.
Figure 2:
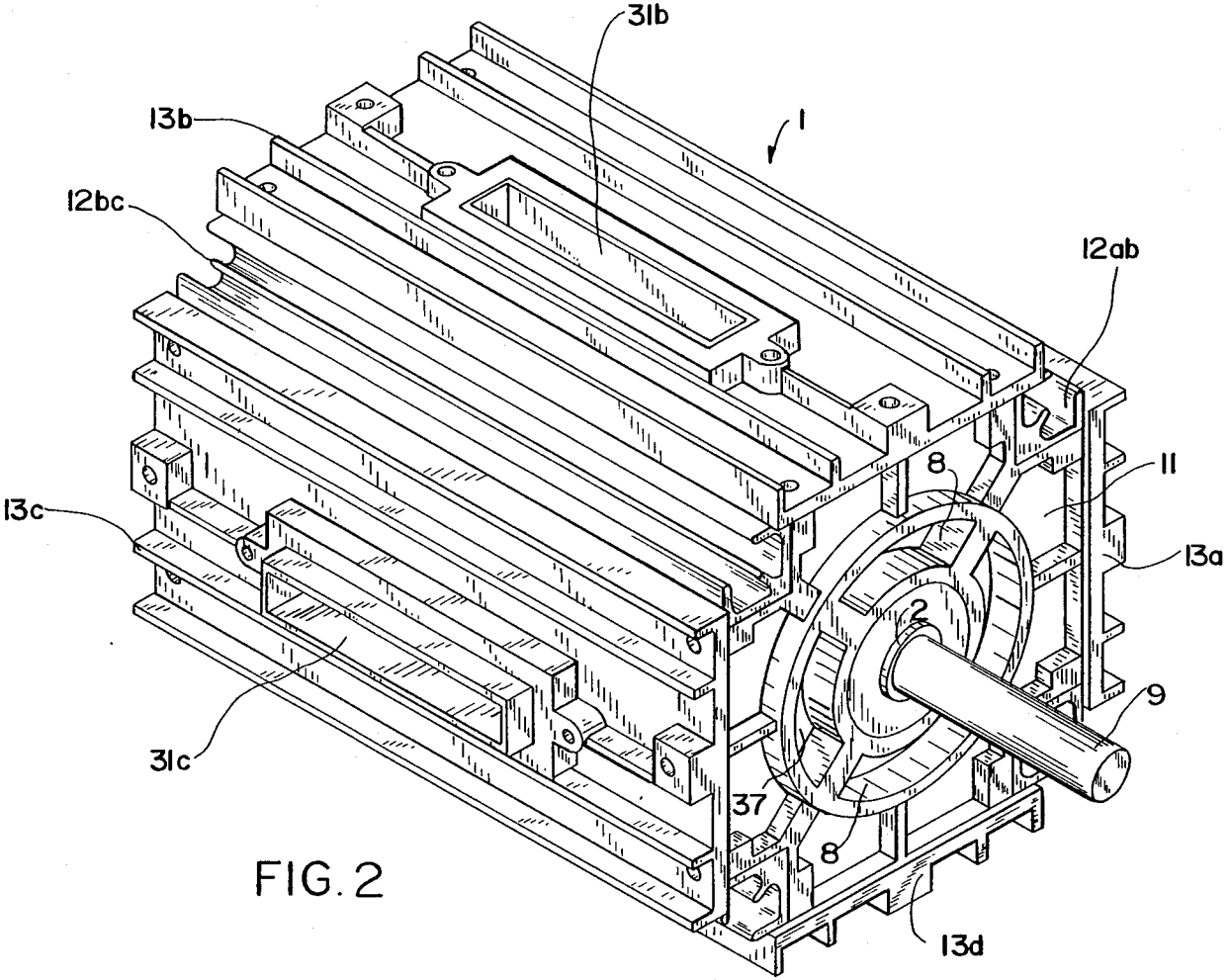
FIG. 2 is a perspective view of the apparatus of FIG. 1 viewed from the opposite side.

As shown in FIGS. 1 and 2, the supercharger, generally indicated at 1, is driven by a crankshaft 2 that is rotated by any desired external force. Air is drawn in through input ports 8 located around the crankshaft 2 and is exhausted through four exhaust ports 31*a*, 31*b*, 31*c*, and 31*d*. The rate at which air is pumped through the supercharger 1, for a given speed of rotation of the shaft 2, is a function of the linear position of a control rod 9 that extends within the crankshaft 2. When the rod 9 is pushed forward into the unit to its limit, no air is pumped. As the control rod is withdrawn the amount of air pumped increases to the maximum capability of the supercharger.

Four displacement chambers 23*a*, 23*b*, 23*c* and 23*d* (FIG. 6) are positioned radially around the crankshaft 2. Each chamber encloses a rectangular piston, 22*a*, 22*b*, 22*c* or 22*d*, slideably mounted within the chamber. Oppositely disposed pistons are synchronized to move simultaneously outwardly and inwardly from the crankshaft 2 to maintain dynamic balancing.

Figure 3:
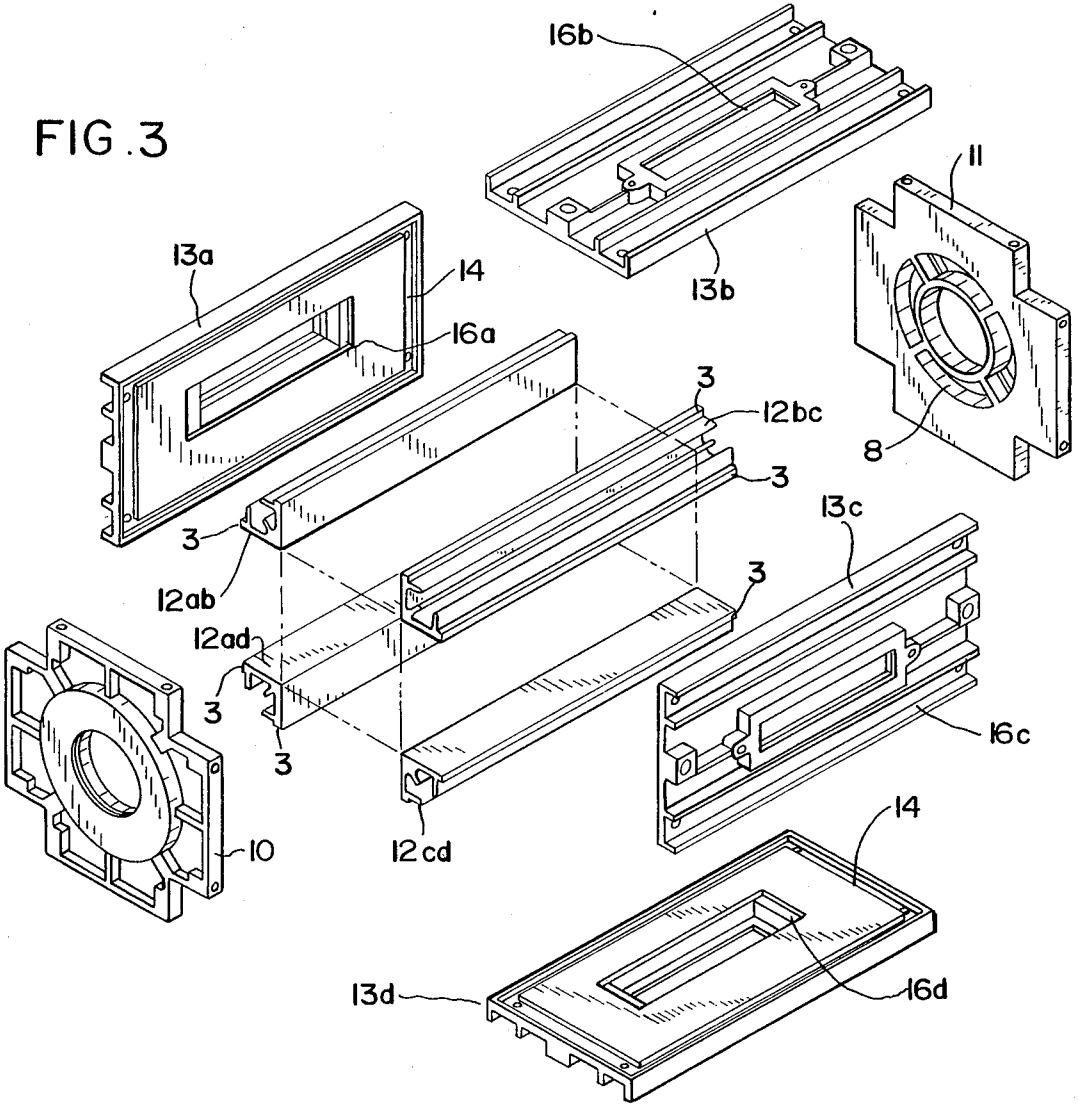
FIG. 3 is an exploded perspective view of the modular elements forming the displacement chambers.

FIG. 3 shows the components that form the displacement chambers 23. Two end plates 10 and 11 provide mounting bearings for the crankshaft 2 and have inner polished surfaces that form opposing end walls of the displacement chambers. The rear end plate 11 contains the input ports 8. The side walls of the displacement chambers 23 are formed by four finned extrusions, 12*bc*, 12*cd*, 12*ad*, and 12*ab*, that receive and position four identical finned displacement chamber covers 13*a*, 13*b*, 13*c*, and 13*d*. Each of the covers 13 contains a rectangular groove 14 that receives two of the longitudinal flanges 3 on the extrusions 12. The edges of the end plates 10 and 11 also extend into the grooves 14 where they are secured by screws (not shown) that extend through openings in the covers 13 into threaded engagement with the plates 10 and 11. A central rectangular opening 16 in each of the covers 13 receives an exhaust duct to be described later.

These parts are secured together only after the internal parts including the crankshaft, crankpins, port plates, pistons, seals and bearings, have been assembled. Because there is no housing around the internal components during their assembly, the time required for assembly of the unit is materially reduced. A gasketing material is applied inside the grooves 14 at final assembly.

Figure 4:
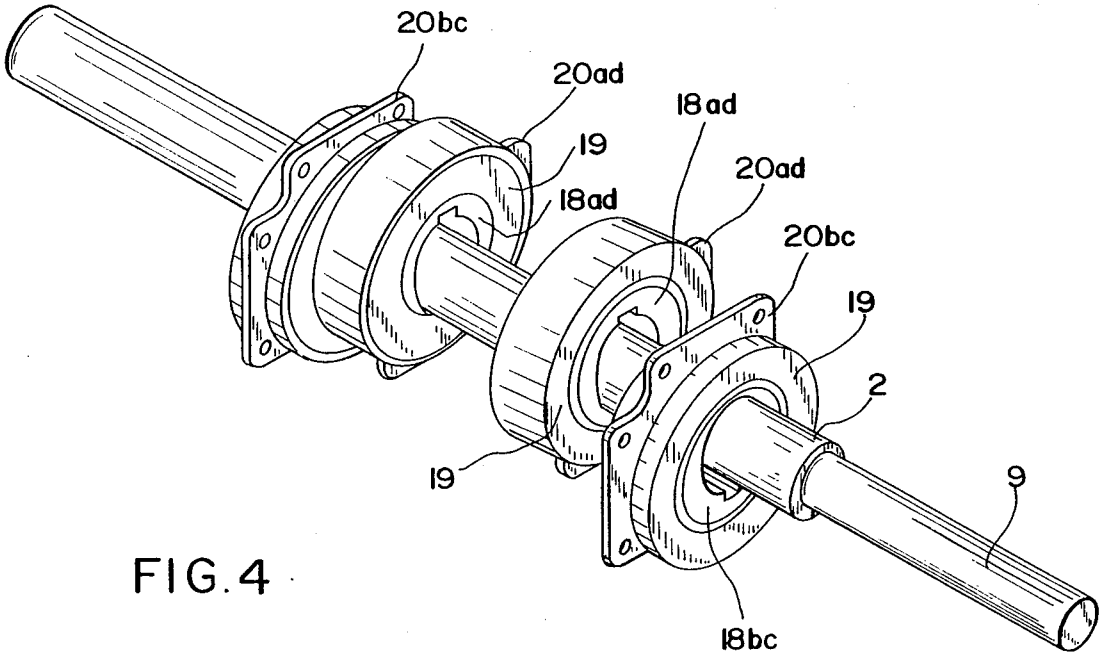
FIG. 4 is a perspective view of the crankshaft with crankpins adjusted for maximum piston throw.
Figure 5:
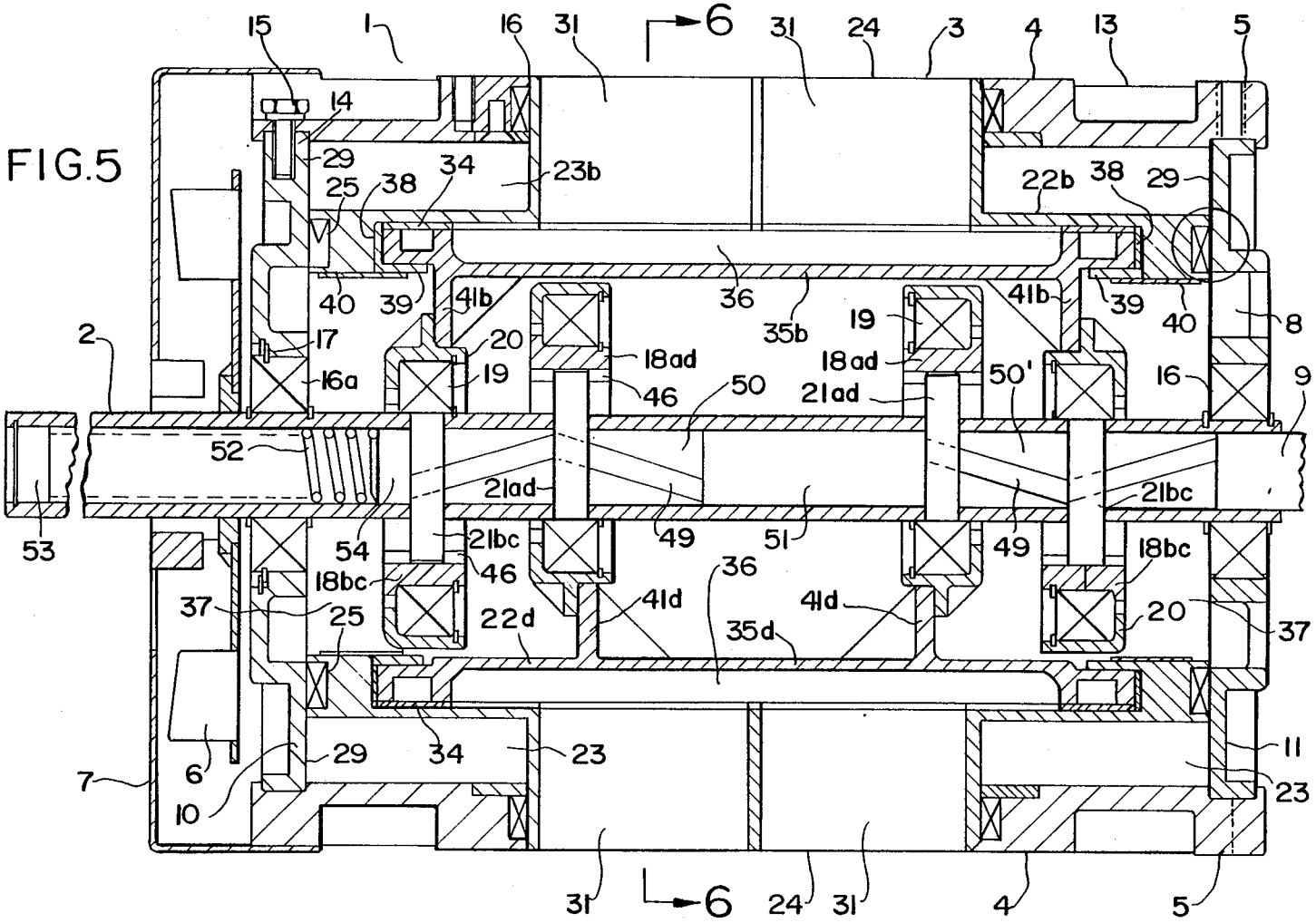
FIG. 5 is a longitudinal cross section along line 5—5 of FIG. 6.

FIGS. 4 and 5 show the crankshaft 2 with two crankpins 18*bc* and two crankpins 18*ad* each mounted within an antifriction sealed-for-life bearing 19. A bearing housing 20*bc* or 20*ad* surrounds each bearing 19 and includes a flange portion for driving the four pistons, as described later. As shown in FIG. 4, the crankpins 18 are in the position of maximum eccentricity to provide maximum piston throw and, accordingly, maximum air displacement. The throw is adjustable by longitudinal movement of the control rod 9. The four crankpin assemblies are identical except for the angular positions of the connecting flanges of the bearing housings 20*bc* and 20*ad*.

The crankpins 18 are circular in shape, but have an elongated central opening (FIG. 6) which contains a keyway 46 that receives one end of an actuating pin 21. The opposite end of the pin 21 abuts the opposite inner surface of the crankpin 18. The actuating pin 21 is capable of sliding freely radially through the crankshaft 2 and has an external recess 48 that is slanting with respect to the longitudinal axis of the actuating pin 21. An equally-slanted projection 49 integral with a control wedge 50, preferably formed in two parts for purposes of assembly, capable of sliding freely within the hollow crankshaft 2 (see also FIG. 5).

The projection 49 on the control wedge 50 extends at an angle relative to the axis of the crankshaft 2 so that as the control rod 9 is moved axially of the crankshaft 2, the elevation of the projection 49, at a fixed point along the axis of the crankshaft 2, moves transversely to the axis of the crankshaft. As shown in FIG. 5, the projections 49 are v-shaped in the direction of the axis of the crankshaft 2. In the position shown, the crankpins are at maximum throw, that is, in position to provide maximum piston excursion. If the control rod 9 were to be moved toward the left from the position shown, the throw of all four crankpins 18 would be reduced by like distances The two outer actuating pins, indicated at 21*bc*, are forced upwardly by the action of the wedge projection 49, thus moving the associated crankpins 18*bc* nearer the center of the axis of the crankshaft 2 and reducing the length of the stroke of the associated pistons. Simultaneously the other two inner actuating pins 21*ad* are moved downwardly by an equal distance to correspondingly reduce the piston throw of the other two chambers.

The position of the control rod 9 is biased toward the right, as viewed in FIG. 5, by a coil spring 52, positioned within the crankshaft 2, that extends between a fixed plug 53 and a movable spacer 54. A spacer 51 is slideably positioned within the crankshaft 2 between the inner ends of the wedge members 50 and 50'. The movable parts within the crankshaft 2 are, in succession from the end of the control rod 9: the first wedge member 50' (which is a mirror image of the second wedge member 50), the separation spacer 51, the second wedge member 50, the movable spacer 54 and the compression spring 52. All of these components are moved to the left by the control rod 9 and returned toward the right by the spring 52 when pressure on the control rod 9 is removed.

Figure 9:
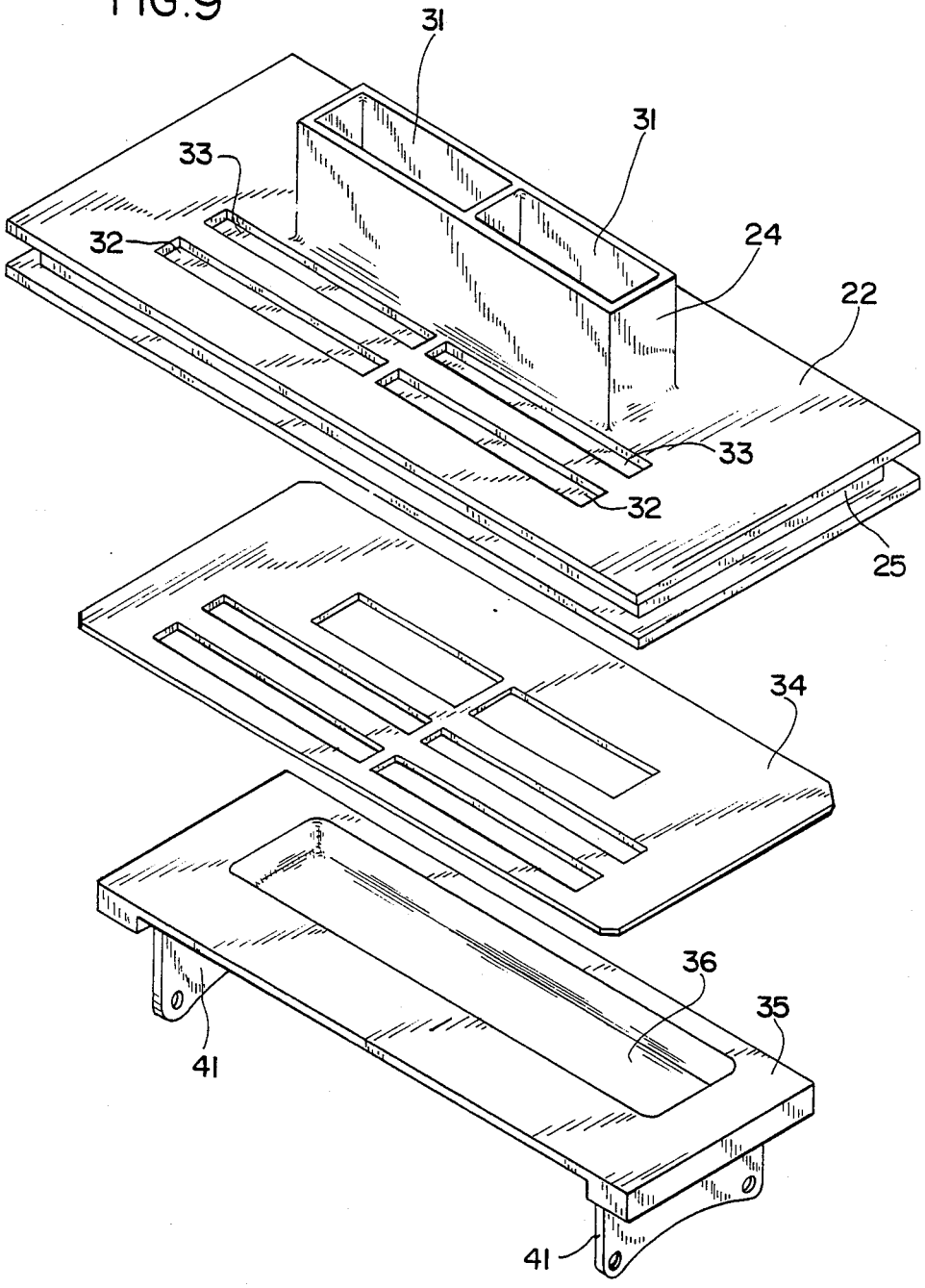
FIG. 9 is an exploded perspective view of one of the piston wear-plate and port-plate assemblies.

The construction of the pistons 22 is illustrated in FIG. 9. Each piston 22 is slideably mounted in one of the displacement chambers 23 and has an integral projecting duct 24 that slides into the opening 16 of one of the covers 13 (FIG. 3). The duct 24 has a channel 31 that is divided into two parts to provide mechanical rigidity. There are two sets of elongated openings in the piston 22 indicated at 32 and 33. These openings 32 and 33 are also divided into two parts only for the purpose of mechanical strength and each pair together provides only a single exhaust or inlet port.

A self-lubricated wear strip 34 is positioned on the inner side of the piston 22 and is provided with openings corresponding to the openings in the piston 22 (FIG. 9).

To control the exhaust and intake ports, and also to transfer driving force to the piston 22, a port plate 35 is positioned against the inner surface of the wear strip 34. A recess 36 in the outer surface of the port plate controls the flow of air between the associated displacement chamber 23 and the opening 31 in the duct 24. When the piston 22 is at its top dead-center position, and also at its bottom dead-center position, the recess 36 in the port plate 35 is positioned directly beneath the duct channel 31 and completely seals it from any communication with the displacement chamber 23. At the mid-stroke position of the piston 22 when the piston is moving to increase the pressure in the displacement chamber 23, the port plate 35 is positioned so that opening 32 is closed by the surface of the port plate, while the opening 33 is connected through the recess 36 to the exhaust channels 31. Air within the displacement chamber 23 is exhausted through the projecting duct 24 to any desired collection means. An external housing (not shown) may be provided to collect the air exhausted from the four ducts 24. On the return stroke when the piston 22 is in its mid-stroke position, the opening 33 and the duct channel 31 are closed by the port plate 35 while the opening 32 is open into the displacement chamber 23 to permit air to enter the chamber from the crankcase as the volume of the chamber increases.

Figure 7:
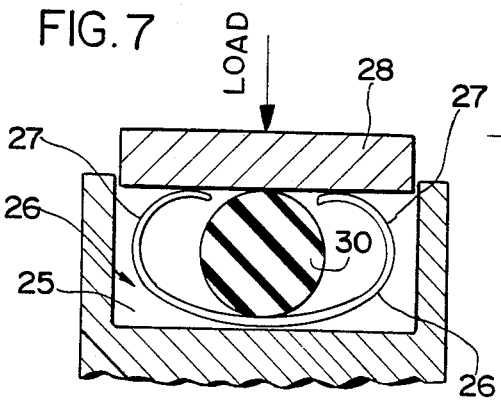
FIG. 7 is an enlarged cross section showing the piston ring seal when not subjected to compressive force.
Figure 8:
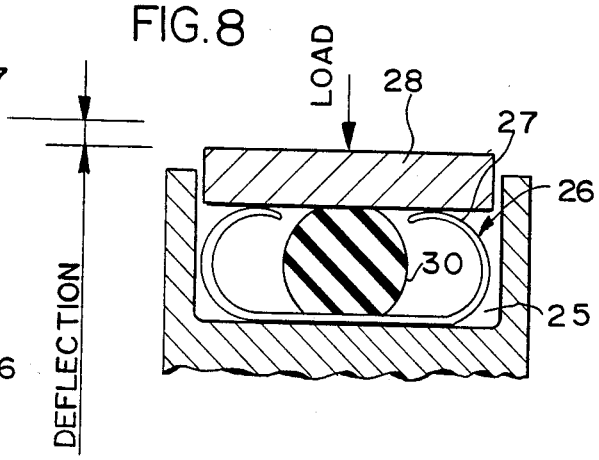
FIG. 8 is a view similar to FIG. 7 when the piston ring seal is under maximum compressional force.
Figure 10:
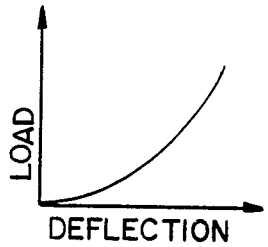
FIG. 10 is a load-deflection curve of the piston ring shown in FIGS. 7–9.
Figure 11:
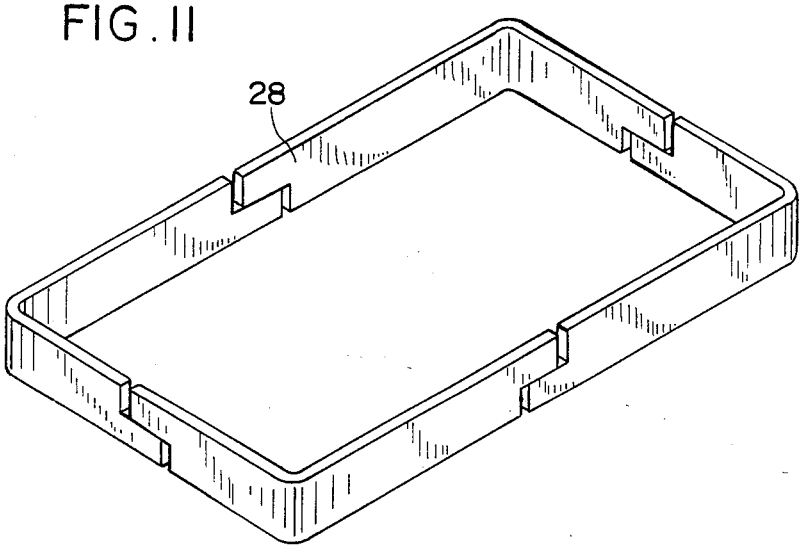
FIG. 11 is a perspective view of the four elements forming a piston ring.
Figure 12:
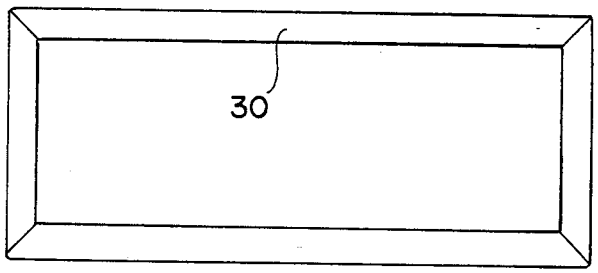
FIG. 12 is a plan view of the one-piece elastomeric seal shown in FIGS. 7 and 8.

It is important that the piston 22 be prevented from touching the side walls of the displacement chamber 23 while providing an effective wear-resistant seal. For this purpose, a groove 25 (FIG. 9) around the piston 22 carries a seal (FIGS. 7 and 8) including an elongated metal spring, generally indicated at 26, with a generally C-shaped cross section. An O-ring 30 (FIG. 12), formed of suitable elastomeric material, is mounted within the spring 26. A piston ring 28 is positioned against the free ends of the spring 27 and also engages the O-ring 30. This piston ring is formed of four separate L-shaped pieces as shown in FIG. 11. In order to resist unusual side forces of the piston 22 and prevent it from coming in contact with the side walls of the displacement chamber 23, the spring 26 has a non-linear reaction to applied forces FIG. 10 illustrates the nature of the deflection of the free ends 27 of the spring 26 as a function of applied load. The fulcrum point of the two arms 27 is at the longitudinal center of the groove 25 as shown in FIG. 7. As the spring is deflected under compressive force of the ring 28, as it is pushed into the groove 26, the fulcrum point becomes a flat, as shown in FIG. 8, and the effective length of the arms 27 becomes progressivly shorter until only the curved ends 27 of the spring 26 provide elasticity. Because the stiffness of a beam is inversely proportional to the cube of its length, the stiffness of the spring 26 increases approximately exponentially with deflection. The elastomeric element 30 may be a single piece 0-ring of rectangular configuration or it may be molded in four individual pieces with mitered and bound corners as illustrated by FIG. 12.

The clearance between the walls of the displacement chamber 23 and the piston 22 must be large enough that the piston never touches the chamber walls: only the ring 28, which is formed of self-lubricating material, touches the walls of the displacement chamber 23. Under normal conditions, a slight pressure applied to the ring 28 maintains it in contact with the chamber walls and insures sealing with minimum sliding resistance. If a side load develops because of a sudden start, pressure surge, or other cause, the spring 26 is compressed further and becomes increasingly stiffer exponentially to prevent the piston 22 from ever coming into contact with the chamber walls.

The opening 16 in the cover 13 (FIG. 3) is provided with a seal arrangement the same as the one just described, except for the dimensions. A groove around the interior of the opening 16 carries the seal spring and the elastomeric seal material as described. This seal makes contact with the outer wall of the projecting duct 24 (FIG. 9) and provides a self-lubricated seal.

Each port plate 35 is guided laterally against its adjacent piston 22 by two wear strips 38 (FIG. 5) and axially during the down stroke by two wear strips 39 that are forced under preload against the under side of the piston 22 by two spring strips 40 which are secured by screws (not shown) to the piston 22.

In order to couple the pistons 22 to the crankpins 18, spaced leg extensions 41 (FIG. 9) are provided. The pistons 22*b* and 22*c* are connected, by the leg extensions 41*b* and 41*c* of the port plates 35*b* and 35*c* respectively, to the bearing flanges forming part of the two bearing housings 20*bc* (FIG. 4). The leg extensions 41 are connected to the housing flanges by suitable bolts (not shown) or other means. The two pistons 22*b* and 22*c* that are adjacent and follow paths perpendicular to each other, are connected to the same set of bearing housings 20*bc*. Opposing pistons cannot be connected to the same bearing housings because of the requirement that the opposing pistons move simultaneously in opposite directions to provide dynamic balancing. The other two pistons 22*a* and 22*d* are connected by the leg extensions 41*a* and 41*d* (FIGS. 5 and 6) to the two bearing housings 20*ad* that are positioned closest together (see also FIG. 4). By this means the desired reactive motion of the pistons is achieved without interference.

In operation, the rotation of the crankshaft 2 causes the crankpin 18 to drive the port plate 35 in a nutating motion with a total excursion equal in distance to twice the throw of the crankpins 18. This distance is controlled by the movement of the actuating pins 21 away from the center of the crankshaft 2. When the control rod 9 pushes the control wedges 50 and 50′ all the way to the left, as viewed in FIG. 5, so that the end of the control rod 9 is nearest the actuating pin 21*bc*, all of the actuating pins 21 are retracted to their maximum position and the throw of the crankpins 18 is zero and the pistons 22 remain stationary in a mid-stroke position. There is no air displacement.

When the control rod 9 is allowed to move toward the right under the force of the spring 52, the control wedges 50 and 50′ and the projections 49 force the pins 21 away from the center line of the crankshaft 2. This increases the throw of the crankpins 18 and the pistons start moving with a total travel distance equal to twice the throw of the crankpins 18.

Figure 6:
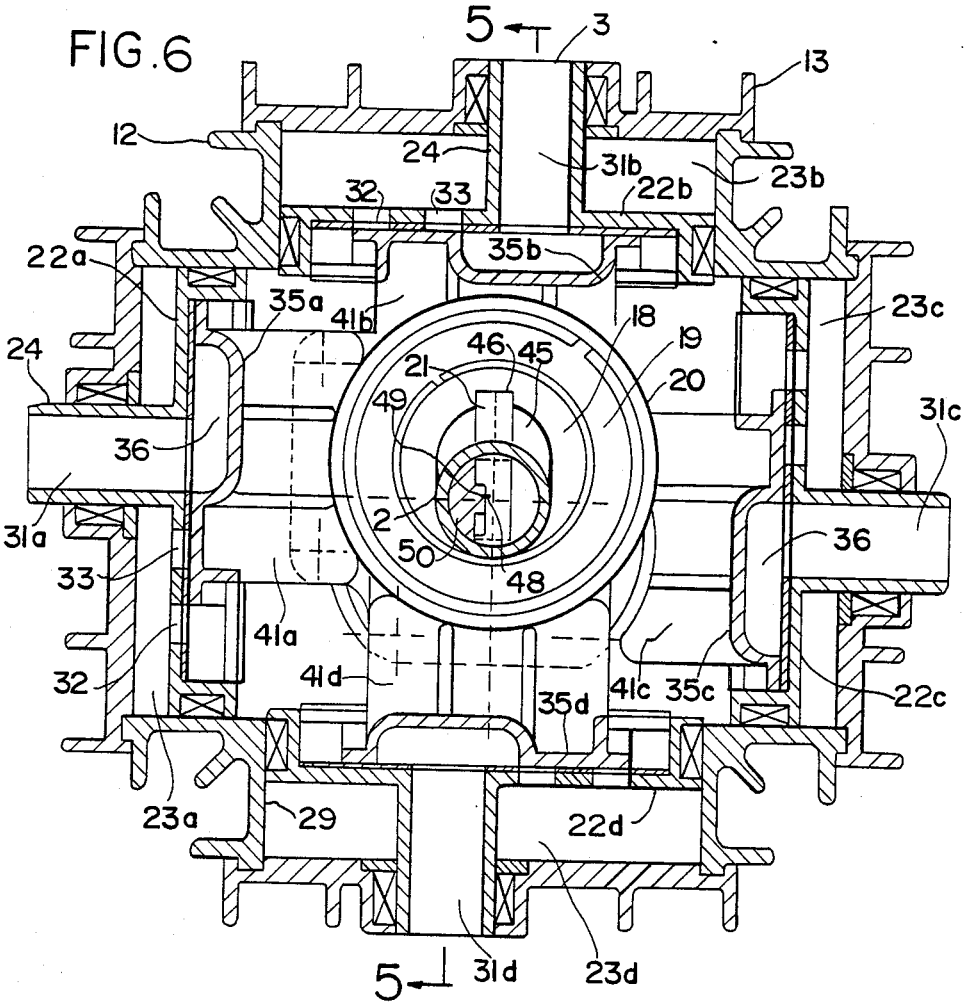
FIG. 6 is a transverse cross section along line 6—6 of FIG. 5.

The torque is transmitted between the crankshaft 2 and the crankpin 18 by the engagement of one end of the pin 21 inside the keyway 46 (FIG. 6). The radial load between the crankpin 18 and the drive shaft 2 is transmitted by the engagement of the projection 49 inside the external recess 48 in the pin 21.

Any position of the actuating pins 21 from maximum retraction (zero displacement) to maximum extended position (maximum displacement) can be selected by changing the linear position of the control rod 9 inside the crankshaft 2.

The first piston actuating assembly for the pistons 22*b* and 22*c* includes the actuating pins 21*bc*, the associated control wedges 50 and 50′, and the bearing housings 20*bc* that are bolted to the port plates 35*b* and 35*c* of the pistons 22*b* and 22*c* through the most widely spaced leg extensions 41*b* and 41*c*. The second piston actuating assembly for the pistons 22*a* and 22*d* includes the actuating pins 21*ad*, the associated control wedges 50 and 50′, and the bearing housings 20*ad* that are bolted to the port plates 35*a* and 35*d* of the pistons 22*a* and 22*d* through the most closely spaced leg extensions 41*a* and 41*d*. The two actuating assemblies are arranged so that upon linear displacement of the control rod 9, the two sets of crankpins 18*bc* and 18*ad* are extended or retracted by exactly the same distance, but in opposite directions. By this means, the two opposing pistons always move in opposite directions by the same distance and at the same speed to insure perfect dynamic balancing.

Figure 13:
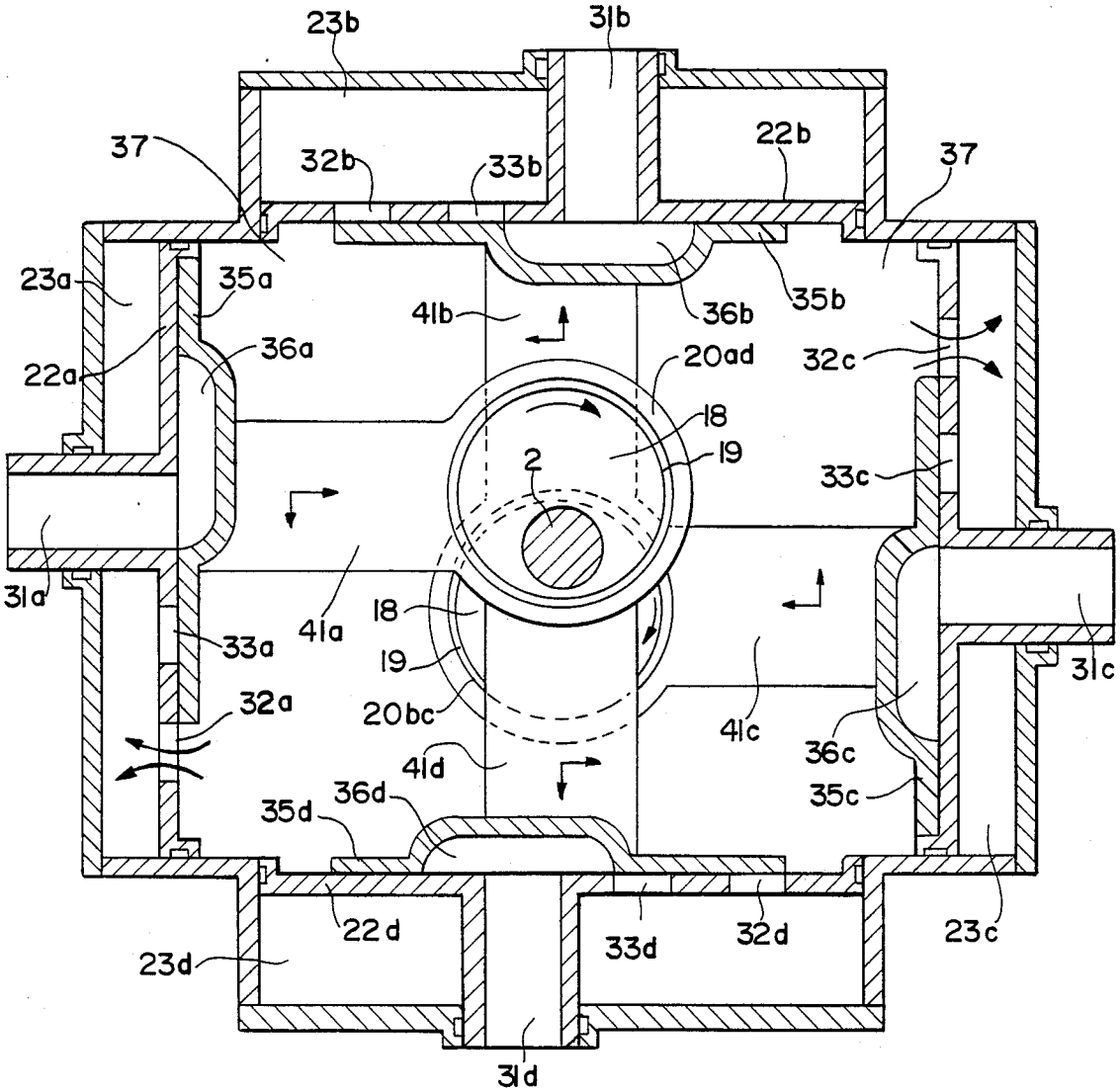
FIG. 13 is a schematic cross section of the piston-crankpin-crankshaft assembly, with the crankshaft positioned at twelve o'clock.

FIG. 13 illustrates, in schematic form, the crankshaft 2 at a twelve o'clock angular reference position. All of the crankpins 18 are at their maximum extended positions away from the axis of the crankshaft 2. The twelve o'clock piston 22*b*, shown at its dead-bottom position, is connected through its matching port plate 35*b* to the bearing housings 20*bc*, which are the ones with the widest spacing, by the two leg extensions 41*b*. The bearing housings 20*bc* are radially offset from the central axis of the crankshaft 2 by the maximum amount.

A second set of leg extensions 41*c*, with the same spacing, are connected to the same bearing housings 20*bc* but extend at an angle of ninety degrees from the leg extensions 41*b* of the port plate 35*b*. These leg extensions are connected to the three o'clock piston 22*c* which is in its mid-stroke position.

The six o'clock piston 22*d*, which is at its dead-bottom position, is connected through its port plate 35*d* to the bearing housings 20*ad*, which have the least spacing, by the leg extensions 41*d*. The crankpins associated with the piston 22*d* are positioned at full offset but in the opposite direction from the crankpins associated with the pistons 22*b* and 22*c*.

The nine o'clock piston 22*a* is connected, through its port plate 35*a*, by leg extensions 41*a*, which extend at an angle of ninety degrees from the leg extensions 41*d*, to the same bearing housings 20*ad*. The piston 22*a* is at its mid-stroke position.

With the crankshaft 2 in its twelve o'clock position as described, all of the port openings, 31*b*, 32*b* and 33*b* are sealed by the port plate 35*b*. The ports, 31*d*, 32*d* and 33*d*, associated with the six o'clock piston 22*d* are also sealed. The displacement chambers 23*c* and 23*a* are open through ports 32*c* and 32*a* to the crankcase 37.

Upon rotation of the crankshaft 2 in a clockwise direction, a nutating motion is imparted simultaneously to all of the port plates 35. The twelve and six o'clock pistons 22*b* and 22*d* move away from the axis of the crankshaft 2 and reduce the displacement of the corresponding chambers 23*b* and 23*d*. The three and nine o'clock pistons 22*a* and 22*c* move toward the center of the supercharger and increase the displacement of the corresponding chambers 23*a* and 23*c*. The twelve o'clock piston port 35*b* slides toward the left, as viewed in FIG. 13, clearing the opening 33*b* and connecting the chamber 23*b* to the openings 31*b* by way of the recess 36*b* in the port plate 35*b*, exhausting the air from the chamber 23*b*.

The six o'clock port plate 35*d* slides toward the right, unseals the opening 33*d* and connects the chamber 23*d* through the port recess 36*d* to the opening 31*d* to exhaust the air from the chamber 23*d*. The three o'clock piston port plate 35*c* slides upwardly, as viewed in FIG. 13, and starts to seal the opening 32*c*. The nine o'clock piston port plate 35*d* slides downwardly and starts to seal the opening 32*d*.

Figure 14:
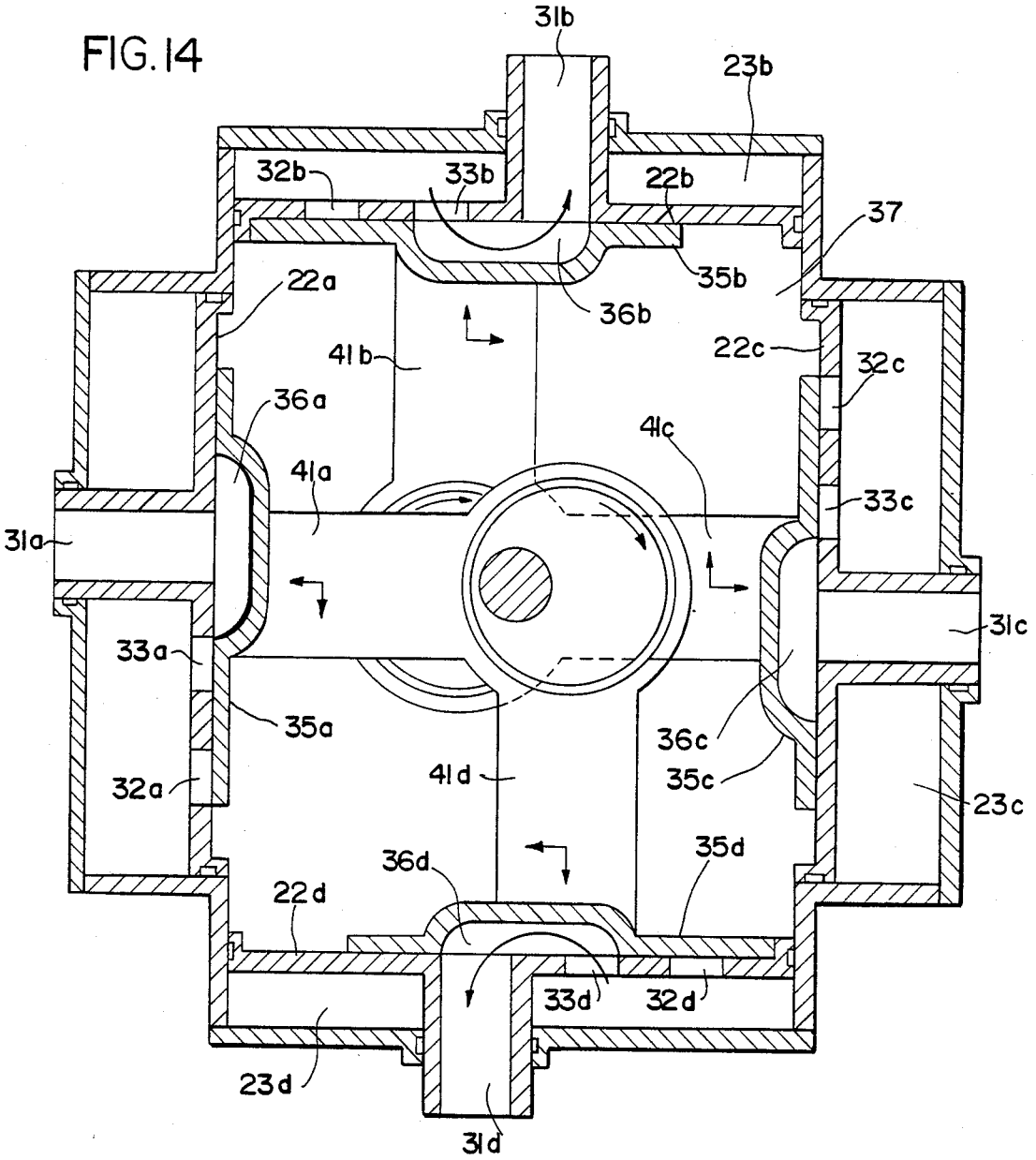
FIG. 14 is the same as FIG. 13 with the crankshaft positioned at three o'clock.

FIG. 14 shows, in schematic form, the crankshaft 2 at its nine o'clock angular position. The twelve and six o'clock pistons 22*b* and 22*d* have moved from dead-bottom to the mid-stroke positions and the port plates 35*b* and 35*d* have unsealed openings 33*b* and 33*d* so that the air in the chambers 23*b* and 23*d* is exhausted through the openings 31*b* and 31*d* by way of the recesses 36*b* and 36*d*. The openings 32*b* and 32*d* are sealed. The three and nine o'clock pistons 22*a* and 22*c* are at dead-bottom positions and all of the openings 31*a*, 31*c*, 32*a*, 32*c*, 33*a*, and 33*c* are sealed.

Figure 15:
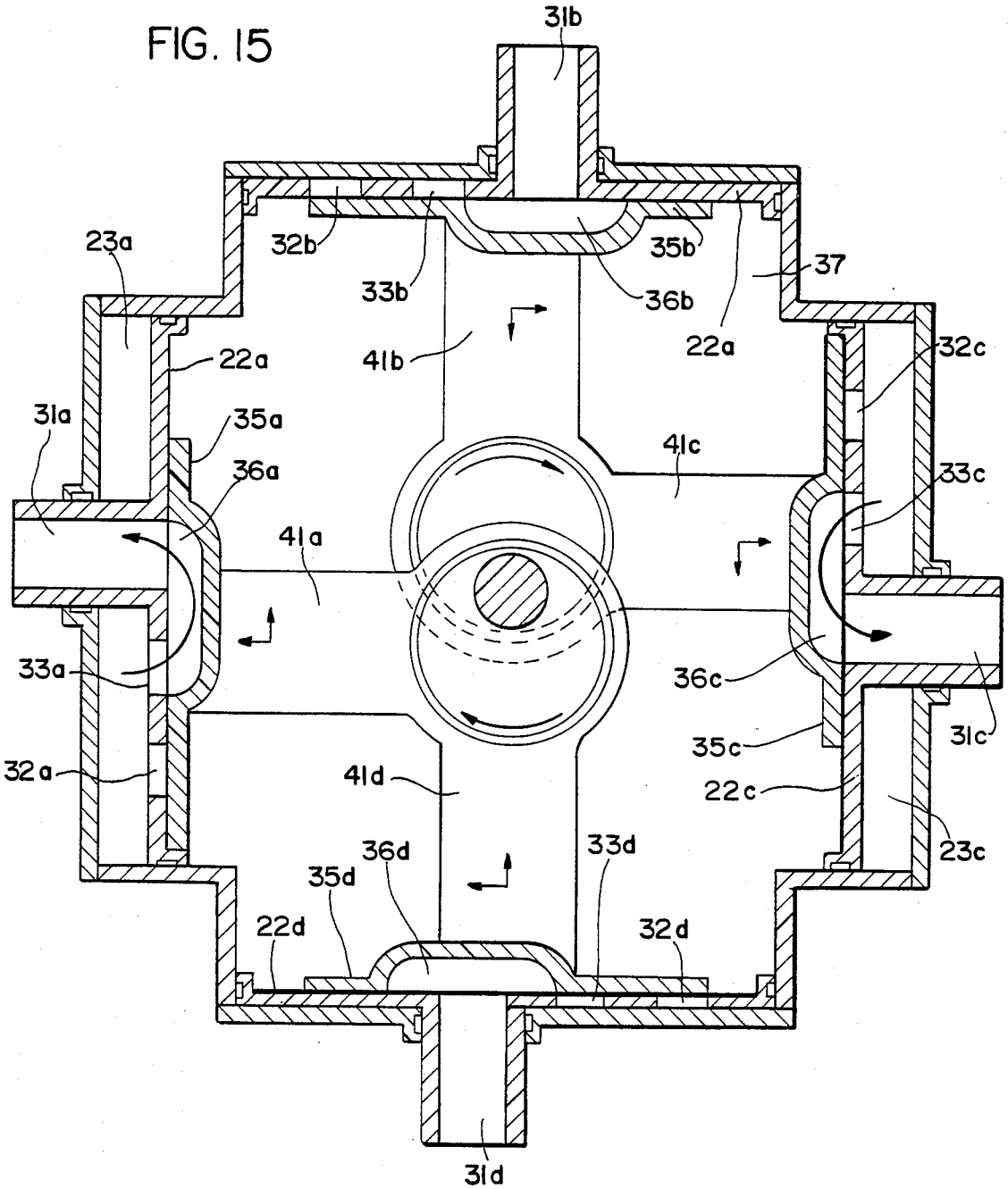
FIG. 15 is the same as FIG. 13 with the crankshaft positioned at six o'clock.

FIG. 15 shows, in schematic form, the crankshaft 2 at its six o'clock angular position. The six and twelve o'clock pistons 22*b* and 22*d* are at their dead-top positions; all of the air has been exhausted from the respective displacement chambers and the openings 31*d*, 31*b*, 32*d*, 32*b*, 33*d*, and 33*b* are sealed.

The three and nine o'clock pistons 22*c* and 22*a* have moved from their dead-bottom positions away from the center of the supercharger and reduced the displacement of the chambers 23*c* and 23*a*. The port plates 35*c* and 35*a* have unsealed openings 33*c* and 33*a* and the air is being exhausted through the openings 31*c*and 31*a*.

Figure 16:
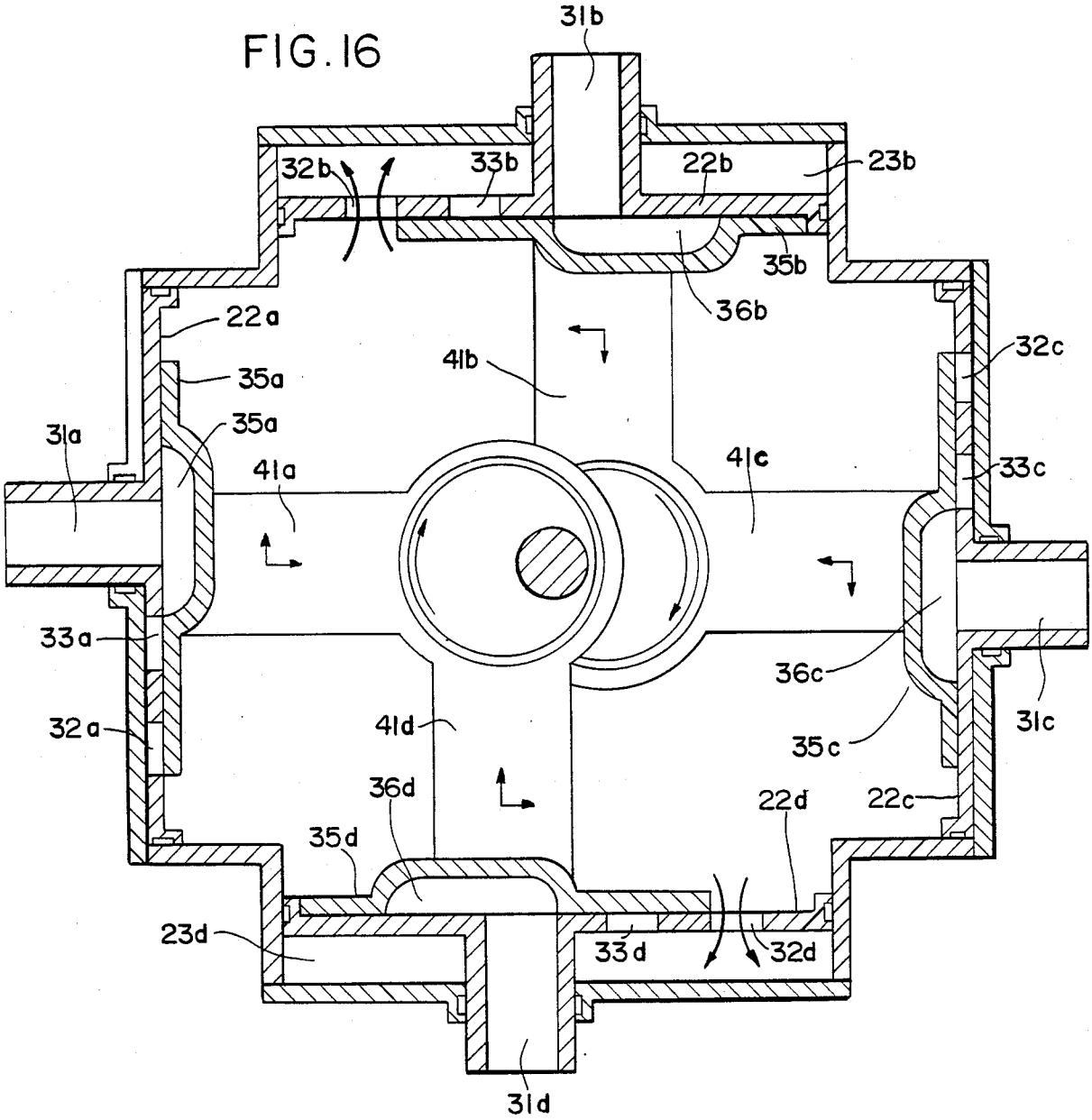
FIG. 16 is the same as FIG. 13 with the crankshaft positioned at nine o'clock.

FIG. 16 shows, in schematic form, the crankshaft 2 at its nine o'clock angular position. The twelve and six o'clock pistons 22*b* and 22*d* have moved from their dead-top positions toward the center of the supercharger and have increased the displacement of the chambers 23*b* and 23*d*. The ports 32*b* and 32*d* are open and the air is being drawn from the crankcase 37 into the chambers 23*b* and 23*d*. The openings 31*b*, 31*d*, 33*b*, and 33*d* are sealed. The three and nine o'clock pistons 22*c* and 22*a* have moved into their dead bottom positions and all ports are sealed.

The exhaust and intake ports are established by the direction of rotation of the crankshaft. Reversing the direction of rotation of the crankshaft 2 reverses the direction of air flow. With reference to FIG. 1, a clockwise rotation of the crankshaft 2 will draw the air in through the ports 8 and exhaust it through the ports 31.

The apparatus has been described as a supercharger for purposes of explanation. However, if air pressure is applied either to the ports 8 or the ports 31, a balanced turning moment is transmitted to the crankshaft 2 and the apparatus operates as a motor.

The piston motion is stabilized by the use of the two spaced crankpins to drive each cylinder. This drive mechanism stabilizes the piston in one plane while it is stabilized in a perpendicular plane by the duct projection 24 that carries the air being exhausted to or drawn into the piston chamber.

The drive system, in which it is the port plate 35 that is connected to the crankpins, provides a simple and effective method of driving the piston and at the same time actuating the ports in the required synchronism with the movement of the piston. In addition, during the compression cycle, the force applied to the port plate provides added sealing pressure for the piston chamber.

The nutating motion imparts to each port plate 35 a translation in two planes: one perpendicular to the axis of the associated piston, called perpendicular translation, and one parallel with the same axis, called parallel translation. The linear velocity of the parallel translation is proportional to the sine of the angle of rotation of the crankshaft 2, and the linear velocity of the perpendicular translation is proportional to the cosine of the angle of rotation of the crankshaft 2. Thus, the parallel translation is at its maximum velocity when the perpendicular translation is zero, and the perpendicular translation reaches maximum velocity when the parallel translation is zero. The perpendicular translation of the port plates 35 provides the valving for air intake and exhaust to and from the chambers 23. The parallel translation provides the driving motion to the pistons 22.

Because the linear velocity of the piston is a function of the sine of the angular displacement of the crankshaft 2 and the linear velocity of the port plate 35 is a function of the cosine of the same angle: while the piston 22 is at maximum velocity, at mid-stroke, the maximum amount of fluid is being drawn in or exhausted, and the port plate is at zero velocity with the port openings fully open for minimum flow restriction.

The two pairs of pistons work in opposing manners so that when one pair of pistons is drawing air in, the other pair is exhausting air. There are two suction pulses and two pressure pulses for each revolution of the crankshaft 2.

The shape and number of pistons illustrated here is by way of example only. Any number of paired pistons, in line or in quadrant, may be used, and the pistons may be of any desired shape. For many applications, however, the use of four pistons of rectangular shape is advantageous over other arrangements.

I claim:

1. In a variable positive fluid displacement apparatus, the combination comprising
- a crankshaft,
- a crankcase surrounding said crankshaft,
- a displacement chamber including
  - a cover,
  - an external port extending through said cover,
  - a piston having first and second internal ports, and
  - a port plate slideably positioned adjacent said piston and having first and second spaced legs extending therefrom,
- first and second eccentric drive means positioned on said crankshaft, and
- means connecting said first and second legs respectively to said first and second drive means, whereby when said crankshaft is rotated, a sliding motion is imparted to said port plate to selectively close and open said ports, and said piston is driven in a direction perpendicular to the plane of the sliding motion of said port plate.

2. Apparatus as claimed in claim 1 wherein
- said port plate includes a recessed passageway by which when said port plate is in a first position, said external port is connected through said recess and said first internal port to said chamber, and when said port plate is in a second position, said external port is sealed from said chamber.

3. Apparatus as claimed in claim 1 wherein
- said port plate has
  - a first sliding position in which said first port provides a conduit between said chamber and said external port,
  - a second sliding position in which said second port provides a conduit between said chamber and said crankcase, and
  - a third sliding position in which said first and second ports are sealed.

4. Apparatus as claimed in claim 1 wherein
- said piston has an external groove, and including
- means slideably sealing said piston within said chamber comprising
  - an elastomeric member positioned within said chamber,
  - a spring member at least partially surrounding said elastomeric member, and
  - a piston ring in engagement with said spring and said elastomeric ring.

5. Apparatus as claimed in claim 4 wherein
- said spring member is generally C-shaped in cross section with a base portion adjacent the base of said groove and having two free end portions engaging said piston ring.

6. Apparatus as claimed in claim 1 wherein said piston and said chamber are rectangular in shape.

7. Apparatus as claimed in claim 1 wherein
each of said eccentric drive means includes
an actuating member movable radially with respect to said crankshaft, and
a crankpin surrounding said crankshaft and having an eccentric position with respect to said shaft that is a function of the radial position of said actuating member, and including
control means for altering the throw of said piston comprising
an adjustable control member movable along the axis of said crankshaft, and
means under the control of said control member movable axially of said crankshaft for adjusting the radial position of said crankpin thereby to alter the excursion of said piston.

8. Apparatus as claimed in claim 1 including
a duct projection formed integrally with said piston and defining a pathway of said external port, and
means slideably sealing said cover around said duct, whereby said spaced legs prevent twisting of said piston in a first direction and said duct projection prevents twisting of said piston in a second direction perpendicular to said first direction.

9. A variable positive fluid displacement apparatus comprising
a crankshaft,
a crankcase surrounding said crankshaft,
first and second chambers,
a first piston assembly slideably positioned within said first chamber having first and second spaced leg members,
a second piston assembly slideably positioned within said second chamber having third and fourth spaced leg members,
first piston drive means connected at spaced positions on said crankshaft to said first and second leg members for reciprocating said first piston assembly, and
second piston drive means connected at spaced positions on said crankshaft to said third and fourth leg members for reciprocating said second piston assembly 10. Apparatus as claimed in claim 9 wherein
said pistons reciprocate along perpendicular axes.

11. Apparatus as claimed in claim 10 wherein
said first and second piston drive means are at the same spaced positions on said crankshaft.

12. Apparatus as claimed in claim 9 wherein
the positions of said first and second leg members on said crankshaft encompass the positions of said third and fourth leg members thereon.

13. Apparatus as claimed in claim 12 wherein
said pistons reciprocate along a common axis.

14. Apparatus as claimed in claim 12 wherein
said pistons reciprocate simultaneously in opposite directions with respect to said crankshaft.

15. Apparatus as claimed in claim 9 wherein
said first piston drive means includes
first and second throw-control members movable in the direction of the axis of said crankshaft and having respectively first and second variable coupling members extending at an angle to said axis,
first and second radially movable actuating members respectively slideably interlocked with said first and second coupling members,
first and second spaced eccentric drive means coupled to said crankshaft and radially adjustable with respect thereto respectively under the control of said first and second actuating members, and
means connecting said first and second leg members respectively to said first and second eccentric drive means,
said second piston drive means includes
third and fourth throw-control members movable in the direction of the axis of said crankshaft and having respectively third and fourth variable coupling members extending at an angle to said axis,
third and fourth radially movable actuating members respectively slideably interlocked with said third and fourth coupling members,
third and fourth spaced eccentric drive means coupled to said crankshaft and radially adjustable with respect thereto respectively under the control of said third and fourth actuating members, and
means connecting said third and fourth leg members respectively to said third and fourth eccentric drive means, and
control means for simultaneously moving said first, second, third and fourth throw-control members thereby to adjust the excursions of said first and second piston assemblies.

16. Apparatus as claimed in claim 15 wherein
said first and second piston assemblies reciprocate along a common axis.

17. Apparatus as claimed in claim 15 wherein
said first and second piston assemblies reciprocate along perpendicular axes.

18. In a fluid displacement apparatus, the method comprising the steps of
providing a displacement chamber,
positioning in said chamber a piston having a plurality of fluid ports,
guiding said piston for reciprocating movement along an axis in said chamber while restraining said piston from angular movement with respect to said axis,
positioning in face-to-face relationship with said piston a port plate having a plurality of fluid ports,
guiding said port plate for movement parallel with and transverse to said axis while restraining said port plate from angular movement with respect to said axis,
driving said port plate with a circular motion whereby the surface of said port plate adjacent said piston describes a circular path while remaining in a plane perpendicular to said axis, the transverse component of movement of said port plate cyclically changing the alignment of said ports in said port plate relative to those in said piston and the component of movement of said port plate parallel with said axis causing reciprocating motion of said piston.

* * * * *